US010576707B2

(12) United States Patent
Park et al.

(10) Patent No.: US 10,576,707 B2
(45) Date of Patent: Mar. 3, 2020

(54) DUNNAGE CONVERSION MACHINE JAM-DETECTION SYSTEM AND METHOD

(71) Applicant: Ranpak Corp., Concord Township, OH (US)

(72) Inventors: Kevin W. Park, Chardon, OH (US); Roger G. Fischer, South Euclid, OH (US)

(73) Assignee: Ranpak Corp., Concord Township, OH (US)

( * ) Notice: Subject to any disclaimer, the term of this patent is extended or adjusted under 35 U.S.C. 154(b) by 559 days.

(21) Appl. No.: 14/891,512

(22) PCT Filed: May 16, 2014

(86) PCT No.: PCT/US2014/038406
§ 371 (c)(1),
(2) Date: Nov. 17, 2015

(87) PCT Pub. No.: WO2014/186712
PCT Pub. Date: Nov. 20, 2014

(65) Prior Publication Data

US 2016/0101585 A1 Apr. 14, 2016

Related U.S. Application Data

(60) Provisional application No. 61/824,054, filed on May 16, 2013.

(51) Int. Cl.
*B31D 5/00* (2017.01)

(52) U.S. Cl.
CPC ..... *B31D 5/0047* (2013.01); *B31D 5/0043* (2013.01); *B31D 2205/0088* (2013.01)

(58) Field of Classification Search
None
See application file for complete search history.

(56) References Cited

U.S. PATENT DOCUMENTS 3,690,225 A * 9/1972 Monaco ..... B31D 5/0013 493/10
3,763,537 A * 10/1973 DiFrank ..... B31D 5/0013 29/429

(Continued)

FOREIGN PATENT DOCUMENTS

WO 2012/174027 A1 12/2012

OTHER PUBLICATIONS

International Search Report for PCT/US2014/038406.

*Primary Examiner* — Michelle Lopez
*Assistant Examiner* — Chinyere J Rushing-Tucker
(74) *Attorney, Agent, or Firm* — Renner, Otto, Boisselle & Sklar, LLP

(57) ABSTRACT

A jam-sensing method for a dunnage conversion machine includes the following steps: (a) converting a stock material into a relatively less dense dunnage material having characteristics that vary along the length of the dunnage material; (b) sensing the characteristics of the dunnage material; (c) generating a signal that varies as a function of the sensed characteristics; (d) monitoring the generated signal over time; and (e) generating a control signal when variation in the generated signal within a predetermined period is less than a predetermined amount, which would indicate a lack of movement of the material. This control signal can used to shut down the conversion process, thereby minimizing the extent of the jam condition.

17 Claims, 3 Drawing Sheets

(56) References Cited

U.S. PATENT DOCUMENTS

| | | | | |
|---|---|---|---|---|
| 5,778,631 | A * | 7/1998 | Simmons | B31D 5/0047 493/352 |
| 2001/0019990 | A1* | 9/2001 | Harding | B31D 5/0047 493/22 |
| 2002/0037796 | A1* | 3/2002 | Harding | B31D 5/0047 493/350 |
| 2002/0137617 | A1* | 9/2002 | Kobben | B26D 1/08 493/350 |
| 2005/0178085 | A1* | 8/2005 | Huis | B31D 5/0073 53/403 |
| 2007/0021286 | A1* | 1/2007 | Kobben | B31D 5/0047 493/464 |
| 2008/0092488 | A1* | 4/2008 | Gabrielsen | B65B 55/20 53/428 |
| 2008/0098699 | A1* | 5/2008 | Cheich | B31D 5/0047 53/472 |
| 2009/0082187 | A1* | 3/2009 | Cheich | B31D 5/0047 493/350 |
| 2011/0016833 | A1* | 1/2011 | Carlson | B65B 55/20 53/473 |
| 2011/0197550 | A1* | 8/2011 | Carlson | B31D 5/0047 53/472 |
| 2013/0296154 | A1* | 11/2013 | Sip | B31D 5/0047 493/464 |
| 2016/0060014 | A1* | 3/2016 | Timmers | B31D 5/0043 493/352 |
| 2017/0259522 | A1* | 9/2017 | Cheich | B31D 5/0047 |

* cited by examiner

DUNNAGE CONVERSION MACHINE JAM-DETECTION SYSTEM AND METHOD

This application is a national phase of International Application No. PCT/US2014/038406 filed May 16, 2014, and published in the English language, which claims priority to U.S. Provisional Application No. 61/824,054 filed May 16, 2013.

FIELD OF THE INVENTION

This invention is related to dunnage machines, and more particularly to machines and methods for converting a sheet stock material into a relatively less dense dunnage product.

BACKGROUND

In the process of shipping one or more articles in a container, dunnage products typically are placed in the container to fill voids and to protect the articles during shipment. Such dunnage products can be made of plastic, such as air bags or bubble wrap, or paper, such as a crumpled paper dunnage product. Some examples of machines that convert plastic or paper sheets into dunnage products include U.S. Pat. Nos. 7,950,433 and 7,220,476. Exemplary crumpled paper dunnage conversion machines include U.S. Pat. Nos. 8,177,697 and 8,114,490.

As these machines advance a sheet of paper or plastic through their respective conversion assemblies that convert the sheet stock material into relatively less dense dunnage products, sometimes the material will jam in some component of the machine. The jam can occur before or after the stock material is converted into a dunnage material. When a jam occurs, the operator must stop the machine to clear the jam, and discard any damaged material in the process.

SUMMARY

The present invention provides a way to detect and prevent potential jams in a dunnage conversion machine by monitoring the movement of the material after it has been converted into a dunnage material with a varying profile. The system provided by the invention identifies a jam condition or potential jam condition as occurring when the dunnage material is not moving, and automatically stops the conversion process, thereby minimizing or preventing both damage to the dunnage material in process and the downtime required to restart production. Detecting and stopping the conversion process quickly also helps to prevent damage to the dunnage conversion machine, particularly its motor or motors. Previous methods of detecting a jam condition did not stop the conversion process before the motor experienced a damaging spike in electrical current.

More particularly, the present invention provides a method for detecting longitudinal movement of a material having a varying surface profile. The method includes the steps of sensing the profile of a surface of a continuous strip of material having a variable surface profile; generating a signal that varies as a function of the sensed profile; monitoring the varying signal over time; and generating a control signal when variation in the signal within a predetermined period is less than a predetermined amount, which would indicate a lack of movement of the material. The control signal can be used to stop the conversion process.

One or more embodiments of the invention can include one or more of the following steps: (a) where the sensing step includes sensing the profile of a strip of material; (b) where the sensing step includes contactlessly sensing the surface profile; (c) converting a sheet material into a relatively less dense dunnage material having a nonplanar surface with a variable surface profile, where the sensing step includes the step of sensing the surface profile of the nonplanar surface of the dunnage material; (d) positioning a sensor relative to a path of the material to sense the variable-contour surface of the dunnage material traveling on the path; (e) where the sensing step includes directing a light source against the surface of the dunnage material and using a sensor to detect light reflected from the surface; (f) where the monitoring step includes resetting a timer in response to a change in the produced signal; (g) positioning a sensor relative to a path of the material to sense the variable-contour surface of the dunnage material traveling on the path; (h) where the sensing step includes directing a light source against the surface of the dunnage material and using a sensor to detect light reflected from the surface; and (i) where the monitoring step includes resetting a timer in response to a change in the produced signal.

The converting step (c) can include one or more of the following (i) randomly crumpling the sheet material to form a dunnage material having a randomly variable surface profile; (ii) feeding a sheet stock material from a supply, including feeding a sheet of paper from the supply; and (iii) stopping the converting step if the monitoring step detects no motion.

The present invention also provides a dunnage conversion machine that includes: (a) a conversion assembly for converting a sheet material into a relatively less dense dunnage material having a nonplanar surface with a longitudinally variable profile and longitudinally advancing the dunnage material along a path; (b) a sensor adjacent the path that is configured to sense the profile of the surface of the dunnage material on the path and to produce a corresponding signal that varies as a function of the sensed surface profile of the dunnage material; and (c) a controller configured to monitor the signal produced by the sensor for changes over time to detect longitudinal motion of the dunnage material, and to generate a control signal when variation in the signal within a predetermined period is less than a predetermined amount, which would indicate a lack of movement of the material, the controller being in communication with the conversion assembly so that the controller can stop the conversion assembly in response to the sensor signal. The controller can include a processor, such as a microprocessor, a memory, and related software to configure the processor for carrying out the controller functions.

In one or more embodiments, the conversion machine provided by the invention can include one or more of the following characteristics: (i) a supply of sheet material that includes paper; (ii) the conversion assembly includes at least two rotating members arranged to draw the sheet material from the supply; (iii) the conversion assembly includes at least two sets of rotating members, including a first set located downstream of a second set, and the first set drawing the sheet material thereby at a first rate and the second set drawing the sheet material thereby at a second rate that is greater than the first rate such that the sheet material randomly crumples as the sheet material travels from the first set to the second set; (iv) where the conversion assembly randomly crumples the stock material to produce a dunnage material with a randomly crumpled surface profile; (v) where the sensor is a photosensor; and (vi) where the sensor includes a light source.

The present invention further provides a method for identifying a jam state in a dunnage conversion machine.

The method includes the following steps (a) converting a stock material into a relatively less dense dunnage material having characteristics that vary along the length of the dunnage material; (b) sensing the characteristics of the dunnage material; (c) generating a signal that varies as a function of the sensed characteristics; (d) monitoring the generated signal over time; and (e) generating a control signal when variation in the generated signal within a predetermined period is less than a predetermined amount, which would indicate a lack of movement of the material.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

The present invention provides a way to detect and prevent potential jams in a dunnage conversion system by monitoring the movement of dunnage material produced by a dunnage conversion machine. The dunnage conversion machine convert a sheet stock material into relatively less dense dunnage material with a varying profile or other varying characteristic. The system uses a sensor and a controller that can control the dunnage conversion machine based on the sensor output. The sensor detects the varying profile, or other varying characteristic of the dunnage material, and outputs a signal that varies as a function of the detected profile as the dunnage material longitudinally advances past the sensor. When the signal does not vary within a predetermined period, the controller will determine that the dunnage material has stopped, indicating a jam state or condition, or a potential jam state or condition, and will stop the conversion machine so that the jam can be cleared more quickly with less damage to the dunnage material and the conversion machine.

One of the present methods of jam detection includes monitoring the current drawn by a feed motor in the dunnage conversion machine. An increase in the current above a predetermined value is used to identify a jam state. The dunnage material typically stops before the motor current increases, and the feed motor continues to advance or attempts to advance the dunnage material until the current drawn by the motor reaches the predetermined value, increasing the severity of the jam condition, making the jam more difficult to clear, and damaging both the dunnage material and the motor in the process. The method provided by the invention detects the lack of movement of the dunnage material to identify a jam state more quickly, preventing or minimizing damage to the dunnage material and the feed motor, and making it easier for an operator to clear the jam condition and return the conversion machine to production.

Figure 1:
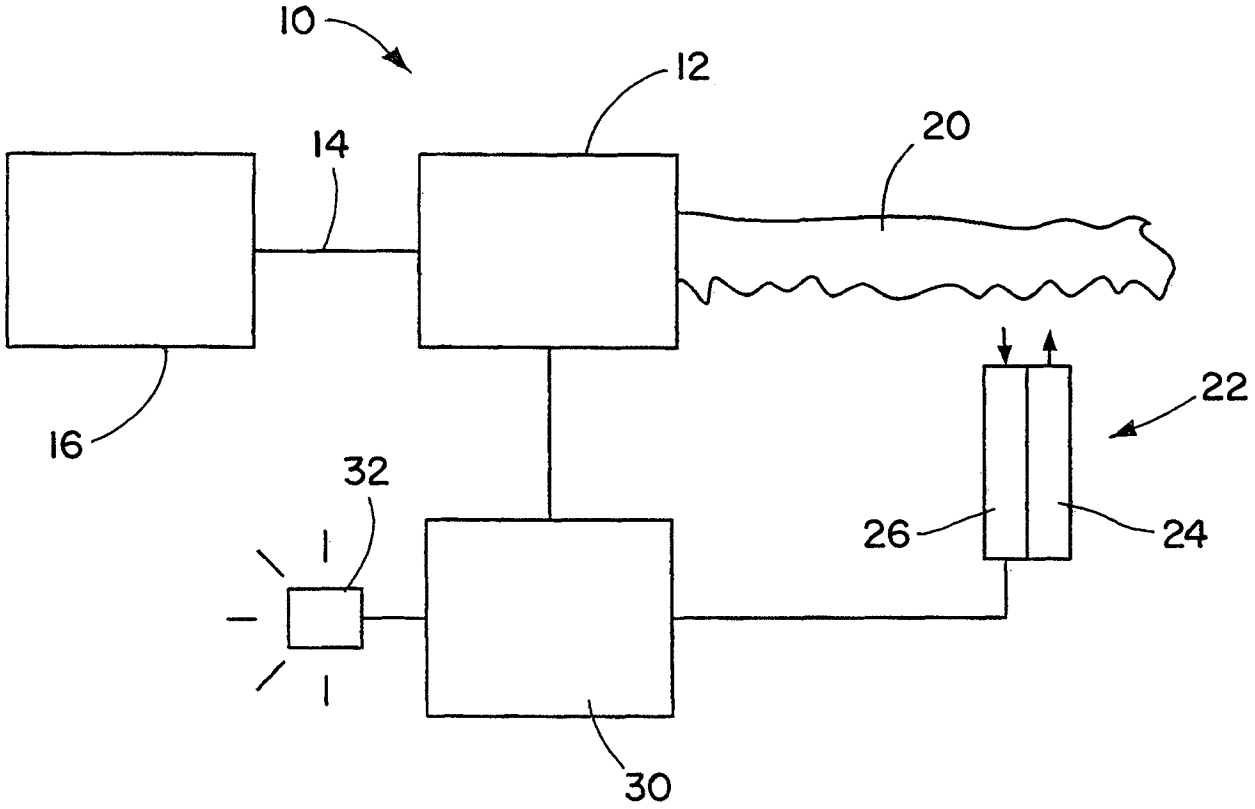
FIG. 1 is a schematic illustration of a generic dunnage conversion machine jam-detection system in accordance with the present invention.

Turning now to the drawings, and initially FIG. 1, the present invention provides a dunnage conversion system 10 and method for identifying a jam state (also referred to as a "jam condition" or simply a "jam") in a dunnage conversion assembly 12. A stock material 14, typically a sheet stock material, is fed from a supply 16 into the conversion machine 12. An exemplary stock material includes plastic sheet material or a paper sheet material. The sheet stock material can be provided in the form of discrete sheets, a fan-fold stack, or a roll. The dunnage conversion assembly 12 converts the sheet material 14 into a relatively lower density dunnage material 20 as the sheet material travels along a path through and out of the conversion assembly 12. The dunnage material 20 of FIG. 1 is a schematic representative of any type dunnage material. The dunnage material 20 can form discrete dunnage products or can be separated into discrete dunnage products. The dunnage material 20 has a characteristic that varies along the length of the dunnage material, such as a profile of the surface of the dunnage material. The longitudinally-varying characteristics include any characteristic that can vary over the length of the dunnage material, including electrical or magnetic characteristics, visual characteristics, density, etc.

The system 10 provided by the invention also includes a sensor 22 positioned to detect variations in a characteristic of the dunnage material as it moves along the path. An exemplary sensor 22 includes a photosensor, also called a photosensor or retro-reflective sensor, which includes a light source 24 and a light detector 26. The light source 24 directs light toward the path of the dunnage material 20 and the light detector 26 detects light reflected from the dunnage material 20 on the path, specifically from the surface of the dunnage material. Variations in the surface profile will reflect different amounts of light to the light detector 26. The sensor 22 outputs a signal that is a function of the detected variations in the characteristics of the dunnage material 20, such as its surface profile.

Alternatively, sensor 22 can be mounted such that its detection range, for example on the order of about seven to twenty millimeters, is broken by peaks in the surface profile but cleared by valleys. As a result, the output of the sensor can be a pulse train rather than a continuous signal.

The dunnage system 10 also includes a controller 30 that is configured to receive the signal from the sensor 22 and control the conversion assembly 12 based on that signal. The controller 30 typically includes a processor, such as a microprocessor, a memory, and related software that configure the controller 30 to carry out its functions. The controller 30 also can include an output device 32 that can be used to alert an operator to a jam or other condition that requires an operator's attention. An exemplary output device 32 provides an audio or visual cue to the operator, such as a speaker or a light.

The controller 30 is configured to analyze the signal from the sensor 22 to identify when the sensor signal indicates that the dunnage material 20 has stopped, indicating a potential jam state, and to output a control signal to control the dunnage conversion assembly 12 as a function of the signal from the sensor 22. In general, the sensor signal is a function of the varying characteristic of the dunnage material 20, and if the sensor signal does not vary for a predetermined period, the controller 30 treats the sensor signal as indicating a potential jam. Then the controller 30 outputs the control signal to stop the conversion assembly 12, and outputs a signal through the output device 32 to alert an operator.

In the situation where the sensor 22 outputs a pulse train, as in the above example, the controller 30 can analyze the signal by using a timer that determines the maximum amount of time that the dunnage material could be stopped before a jam is indicated. Each transition in the pulse train can cause the timer to reset. And if the timer runs out before a transition has occurred, the controller 30 will stop the conversion assembly 12 and notify the operator via the output device 32.

Similarly, one or more analog optical sensors can be used with controlled optical emitter sources to observe the changing characteristics of the dunnage material. The controller can one or more emitter sources in coordination with analog values obtained from one or more analog optical sensors to determine whether the dunnage material is moving. The controller accumulates analog voltage readings from the optical sensors, and can determine whether the dunnage material is moving based on the accumulated readings.

The conversion assembly 12, the controller 30, and the sensor 22 can be contained within a common housing (not shown). These components can be collectively referred to as parts of a dunnage conversion machine.

The operator can then clear the jam or potential jam, and restart the dunnage conversion assembly 12. Sometimes a simple tug on the dunnage material 20 extending from the conversion assembly 12 is sufficient to clear the jam. But even when the operator must open a housing to access the conversion assembly 12 to clear the jam, because the system 10 identifies the potential jam condition so quickly, the extent of the jam and the quantity of dunnage material 20 damaged during the jam condition will both be greatly reduced.

Accordingly, a method provided by the invention includes the following steps: (a) converting, such as with a dunnage conversion assembly, a stock material into a relatively less dense dunnage material having characteristics that vary along the length of the dunnage material; (b) sensing or detecting, such as with a sensor, the characteristics of the dunnage material; (c) generating a sensor signal that varies as a function of the sensed characteristics; (d) monitoring the generated sensor signal over time, for example, by using a controller configured to handle such an operation; and (e) generating a control signal when variation in the generated sensor signal within a predetermined period is less than a predetermined amount, which would indicate a lack of movement of the material. As noted above, this control signal can be generated by the controller to shut down the dunnage conversion assembly 12.

Figure 2:
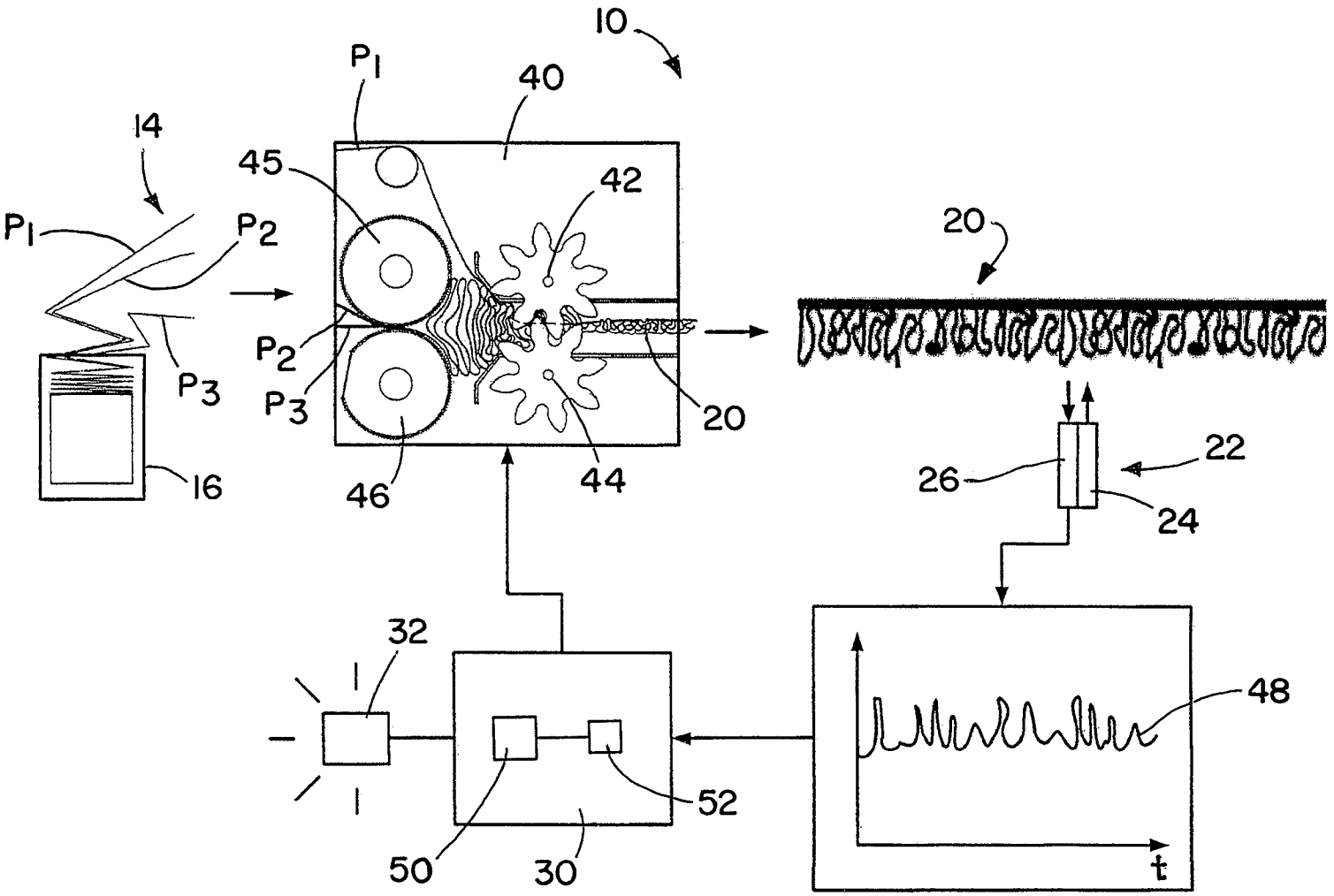
FIG. 2 is a partially-schematic illustration of a particular dunnage conversion machine jam-detection system and a generated sensor signal.

Turning now to FIG. 2, further details of an exemplary dunnage conversion system 10 provided by the present invention are shown in FIG. 2. The dunnage conversion system 10 includes a conversion assembly 40 for converting a sheet stock material 14, in this case a multi-ply sheet material, and in particular a sheet material with three plies, $P_1$, $P_2$, and $P_3$, into a relatively less dense dunnage material 20. The dunnage material 20 has a nonplanar surface with a longitudinally-variable profile, and the conversion assembly 40 longitudinally advances the dunnage material 20 along a path from a stock supply 16 and into, through, and out of the conversion assembly 12.

The conversion assembly 40 includes at least two rotating members 42 and 44 arranged to draw the sheet material 14 from the supply 16. Specifically, the illustrated conversion assembly 40 includes at least two sets of rotating members, including a first set 42 and 44 located downstream of a second set 45 and 46, and the first set 42 and 44 drawing the sheet material thereby at a first rate and the second set 45 and 46 drawing the sheet material thereby at a second rate that is greater than the first rate such that the sheet material 14 randomly crumples as the sheet material travels from the first set to the second set. This random crumpling produces a dunnage material 20 with a randomly crumpled surface profile.

The system 10 further includes a sensor 22 adjacent the path that is configured to sense the profile of the surface of the dunnage material 20 on the path. The sensor 22 generates a signal (graphically shown at 48) that varies as a function of the sensed surface profile of the dunnage material 20. Finally, the system 10 includes a controller 30 having a microprocessor 50 and a memory 52, in addition to the previously-described output device 32 for alerting an operator. The controller 30 is configured to monitor the signal 48 generated by the sensor 22 for changes over time to detect longitudinal motion of the dunnage material 20. The controller 30 also generates a control signal when variation in the sensor signal within a predetermined period is less than a predetermined value, which would indicate a lack of movement of the material. In that case, the controller 30, being in communication with the conversion assembly 40, can output the control signal to stop the conversion assembly 40 in response to the generated sensor signal.

Figure 3:
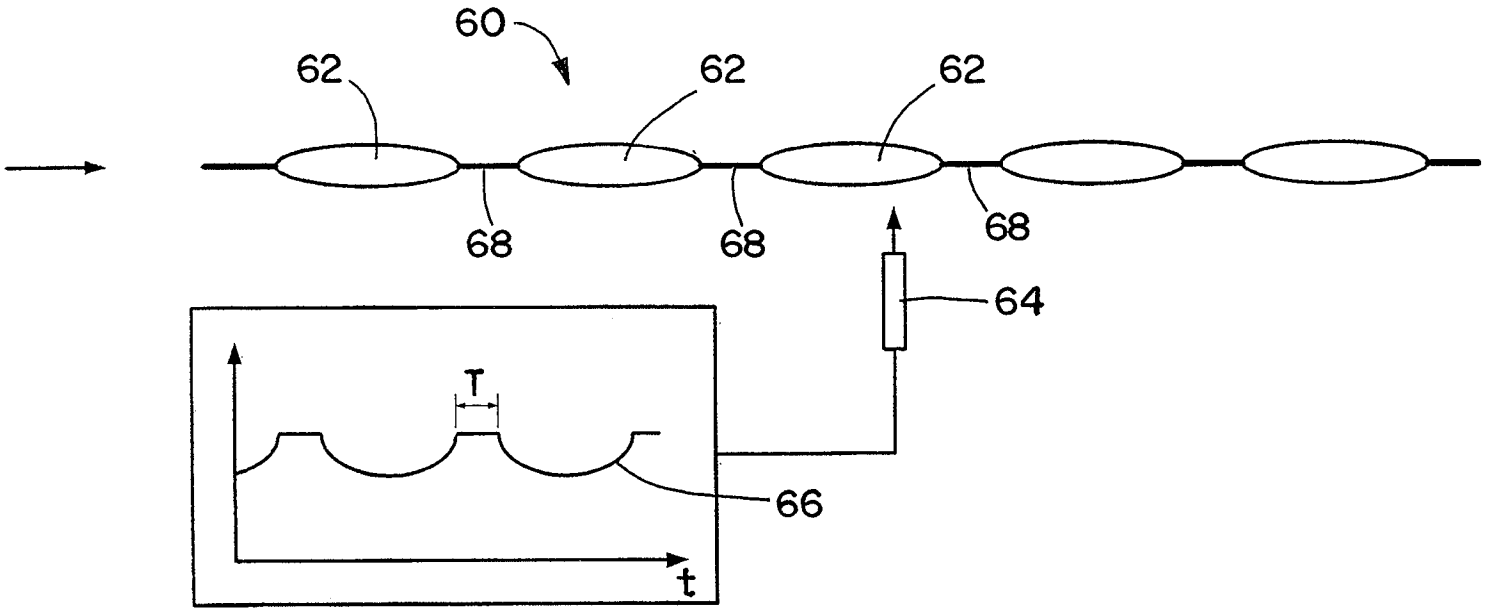
FIG. 3 is a partially-schematic illustration of another type of dunnage material and generated sensor signal.

The present invention is not limited to a crumpled dunnage product, and can be used with any dunnage conversion machine that produces dunnage material from a sheet material, such as the dunnage material 60 shown in FIG. 3. In this case, the dunnage material 60 can be made of pockets 62 of air or other gases sealed between plastic sheets. A sensor 64 detects a characteristic that varies along the length of the dunnage material 60, such as the surface profile, and generates a sensor signal 66 as a function of the detected surface profile. This dunnage material 60 has a portion 68 that is substantially planar and might not produce any variation in the detected surface profile. Consequently, the controller must look for variations in the sensor signal 64 that represent a period greater than the time T, the time during which the planar portion 68 would normally take to pass the sensor 64.

Accordingly, the present invention also provides a corresponding method for detecting longitudinal movement of a material having a characteristic that varies along the length of the dunnage material, particularly a varying surface profile. The method includes the steps of: (a) sensing the profile of a surface of a continuous strip of material having a variable surface profile; (b) generating a signal that varies as a function of the sensed profile; (c) monitoring the varying signal over time; and (d) generating a control signal when variation in the signal within a predetermined period is less than a predetermined amount, which would indicate a lack of movement of the material. The control signal can be communicated to a dunnage conversion machine having a conversion assembly, and the method can include the step of stopping the converting step if the monitoring step detects no motion. In other words, the conversion machine can stop the conversion assembly in response to the control signal.

The converting step can include randomly crumpling the sheet material to form a dunnage material having a randomly variable surface profile. A particular embodiment of the method provided by the invention can include converting a sheet material into a relatively less dense dunnage material having a nonplanar surface with a variable surface profile, where the sensing step includes the step of sensing the surface profile of the nonplanar surface of the dunnage material.

The method also can include the step of feeding a sheet stock material from a supply into the dunnage conversion machine, and the feeding step can include feeding a sheet of paper from the supply into the dunnage conversion machine.

The method can further include the step of positioning a sensor relative to a path of the dunnage material to sense the variable-profile surface (which also can be thought of as the contour of the surface of the dunnage material) of the dunnage material traveling on the path, and contactlessly sensing the surface profile.

If the sensor is a photosensor, for example, the sensing step can include directing a light source against the surface of the dunnage material and using a sensor to detect light reflected from the surface.

The monitoring step includes resetting a timer in response to a change in the produced signal. If the signal does not change within a predetermined period of time, the timer will run out, causing an alarm to issue and the conversion process can be stopped.

In summary, the present invention provides a jam-sensing method for a dunnage conversion machine that includes the following steps: (a) converting a stock material into a relatively less dense dunnage material having characteristics that vary along the length of the dunnage material; (b) sensing the characteristics of the dunnage material; (c) generating a signal that varies as a function of the sensed characteristics; (d) monitoring the generated signal over time; and (e) generating a control signal when variation in the generated signal within a predetermined period is less than a predetermined amount, which would indicate a lack of movement of the material. This control signal can used to shut down the dunnage conversion assembly, thereby minimizing the extent of the jam condition and any damage to the dunnage conversion assembly, and making correction of the problem quicker.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A method for detecting longitudinal movement of a material having a varying surface profile, comprising the steps of:

continuously sensing both the presence of and the profile of a surface of a continuous strip of material having a variable surface profile with a contour sensor;

generating a profile signal that varies as a function of the sensed profile;

monitoring the varying profile signal over a predetermined period that is greater than zero; and generating a control signal when variation in the profile signal within the predetermined period is less than a predetermined amount, which would indicate a lack of movement of the material.

2. A method as set forth in claim 1, where the sensing step includes contactlessly sensing the surface profile.

3. A method of making a dunnage material, comprising the method of claim 1, and further comprising a step of converting a sheet material into a dunnage material that is less dense than the sheet material, the dunnage material having a nonplanar surface with a variable surface profile, where the sensing step includes the step of sensing the surface profile of the nonplanar surface of the dunnage material.

4. A method as set forth in claim 3, where the converting step includes randomly crumpling the sheet material to form a dunnage material having a randomly variable surface profile.

5. A method as set forth in claim 3, further comprising a step of feeding a sheet stock material from a supply.

6. A method as set forth in claim 5, where the feeding step includes feeding a sheet of paper from the supply.

7. A method as set forth in claim 3, further comprising a step of stopping the converting step if the monitoring step detects no motion.

8. A method as set forth in claim 1, further comprising a step of positioning a sensor relative to a path of the material to sense the variable-contour surface of the material traveling on the path.

9. A method as set forth in claim 1, where the sensing step includes directing a light source against the surface of the material and using a sensor to detect light reflected from the surface.

10. A dunnage conversion machine, comprising a conversion assembly for converting a sheet material into a relatively less dense dunnage material having a nonplanar surface with a longitudinally variable profile and longitudinally advancing the dunnage material along a path; and a contour sensor adjacent the path that is configured to sense both the presence of the dunnage material and the profile of the surface of the dunnage material on the path and to produce a corresponding profile signal that varies as a function of the sensed surface profile of the dunnage material; and a controller configured to monitor the profile signal produced by the sensor for changes over a predetermined period that is greater than zero to detect longitudinal motion of the dunnage material, and to generate a control signal when variation in the profile signal within the predetermined period is less than a predetermined amount, which would indicate a lack of movement of the material, the controller being in communication with the conversion assembly so that the controller can stop the conversion assembly in response to the control signal.

11. A dunnage conversion machine as set forth in claim 10, comprising a supply of sheet material that includes paper.

12. A dunnage conversion machine as set forth in claim 10, where the conversion assembly includes at least two rotating members arranged to draw the sheet material from the supply.

13. A dunnage conversion machine as set forth in claim 12, where the conversion assembly includes at least two sets of rotating members, including a first set of rotating members located downstream of a second set of rotating members, and the first set of rotating members drawing the sheet material thereby at a first rate and the second set of rotating members drawing the sheet material thereby at a second rate that is greater than the first rate such that the sheet material randomly crumples as the sheet material travels from the second set of rotating members to the first set of rotating members.

14. A dunnage conversion machine as set forth in claim 10, where the conversion assembly randomly crumples the stock material to produce a dunnage material with a randomly crumpled surface profile.

15. A dunnage conversion machine as set forth in claim 10, where the contour sensor is a photosensor.

16. A dunnage conversion machine as set forth in claim 10, where the contour sensor includes a light source.

17. A dunnage conversion machine as set forth in claim 10, where the controller includes a processor and a memory.

* * * * *